106-15.05 SR
6/23/81 XR 4,274,972

United States Patent [19]
Sherif et al.
[11] 4,274,972
[45] Jun. 23, 1981

[54] PROCESS FOR PREPARING DILUTE AQUEOUS COPPER ZIRCONIUM AMMONIUM CARBONATE SOLUTIONS CONTAINING LESS THAN ABOUT 0.5% CU AND 1.5% $ZRO_2$

[75] Inventors: Sherif A. Sherif, Ewing Township, Mercer County; James E. Hachtmann, High Bridge, both of N.J.

[73] Assignee: Magnesium Elektron Inc., Flemington, N.J.

[21] Appl. No.: 84,227

[22] Filed: Oct. 12, 1979

Related U.S. Application Data

[62] Division of Ser. No. 5,412, Jan. 22, 1979, Pat. No. 4,200,672.

[51] Int. Cl.[3] ..... D06M 13/50
[52] U.S. Cl. ..... 252/8.6; 106/15.05; 260/429.3; 260/438.1; 260/429 J; 424/294
[58] Field of Search ..... 106/15.05; 252/8.6; 260/429.3, 438.1, 429 J; 424/294

[56] References Cited

U.S. PATENT DOCUMENTS

| | | | |
|---|---|---|---|
| 3,183,118 | 5/1968 | Conner et al. . | |
| 3,291,635 | 12/1976 | Conner . | |
| 3,741,782 | 6/1973 | Stewart et al. . | |
| 4,115,422 | 9/1978 | Welch et al. | 260/429.3 |
| 4,175,090 | 11/1979 | Berry | 260/438.1 |

FOREIGN PATENT DOCUMENTS 1337983 11/1973 United Kingdom .

*Primary Examiner*—John D. Smith

[57] ABSTRACT

A process is provided for preparing dilute aqueous copper zirconium ammonium carbonate solutions containing less than about 0.5% Cu and 1.5% $ZrO_2$, having a Cu:Zr atomic ratio within the range from about 0.5:1 to 1:1 and having an enhanced resistance to gelation and the formation of precipitates, upon storage at atmospheric temperatures, which comprises mixing aqueous solutions of ammonium copper carbonate and ammonium zirconyl carbonate in proportions selected to form copper zirconium ammonium carbonate in solution in water in a concentration within the range from about 0.1% to about 0.5% Cu, and an amount sufficient to inhibit gelation and precipitation of a vicinal diol compound having the general formula:

$$R_1—CHOH—CHOH—R_2$$

wherein $R_1$ and $R_2$ are selected from the group consisting of (1) carboxylic acids groups COOH and salts thereof COOM, where M is a cation, and (2) organic groups having at least two up to about twelve carbon atoms and at least one OH group; provided, that when only one of $R_1$ and $R_2$ is a carboxylic acid group or salt thereof, the other of $R_1$ and $R_2$ is an organic group having at least two carbon atoms and two OH groups.

7 Claims, No Drawings

PROCESS FOR PREPARING DILUTE AQUEOUS COPPER ZIRCONIUM AMMONIUM CARBONATE SOLUTIONS CONTAINING LESS THAN ABOUT 0.5% CU AND 1.5% $ZRO_2$

This is a division of application Ser. No. 5,412, filed Jan. 22, 1979, now U.S. Pat. No. 4,200,672, Patented Apr. 29, 1980.

Conner et al U.S. Pat. No. 3,183,118 patented May 11, 1968, describes the formation and subsequent deposition on cotton fabrics of complex water-soluble salts obtained by solubilizing copper, mercury and nickel salts that are normally water-insoluble with zirconyl acetate.

In a subsequent variation, Conner U.S. Pat. No. 3,291,635 patented Dec. 13, 1976, describes the formation and subsequent deposition on cotton fabrics of complex water-soluble derivatives prepared by solubilizing copper and mercury salts that are normally water-insoluble with zirconyl ammonium carbonate.

In both cases, the resulting complex compounds are produced by the chemical reaction of zirconyl acetate or zirconyl ammonium carbonate or ammonium zirconyl carbonate with the water-insoluble chemical compounds of copper, nickel and mercury. Thus, for example, copper borate and other water-insoluble copper salts can be reacted with zirconyl ammonium carbonate solutions, producing a deep blue water-soluble complex which can be decomposed in situ on the cotton fabric, and imparts to the cotton fibers an enhanced resistance to fungal attack.

A rather complex compound is postulated as the reaction product, exemplified by the reaction and formulae at column 3 of U.S. Pat. No. 3,291,635, involving use of copper borate and zirconyl ammonium carbonate:

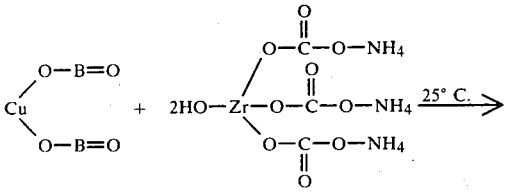

Copper borate M. wt. 149.2

Zirconyl ammonium carbonate Mol. wt. 342.34

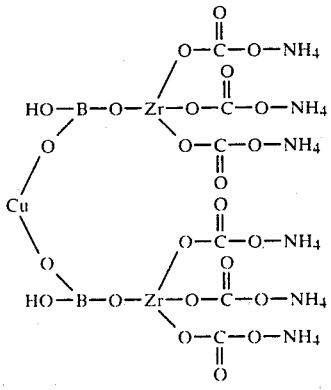

Copper borate-Zirconyl ammonium carbonate derivative (water-soluble) theoretical molecular weight 833.88

This complex decomposes on heating at 50° to 145° C., producing an insoluble complex copper zirconium compound of unknown structure containing copper, zirconium and boron in the molecule:

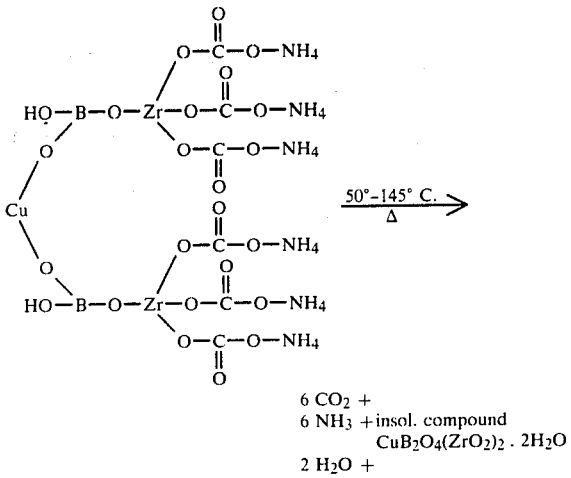

This complex compound becomes chemically attached to the cellulose molecule of the cotton. The insoluble derivative from heat decomposition is blue-green, and shows a strong affinity for cellulose, resisting up to seventy-two hours of water-leaching without evidence of loss of material through dissolution, according to Conner. Conner suggests the possibility of cross-linkage of the zirconium compound produced with cellulose, by the heat decomposition, and further heat causes the loss of water which results in oxo bonding of the zirconium with the cellulose. Conner proposes the structure for the heat-decomposed copper borate-zirconyl ammonium carbonate residual as:

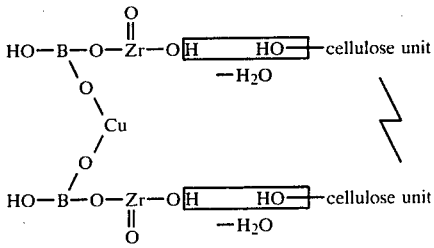

Recently, Conner, Brysson, Walker, Harper and Reeves, of the Southern Regional Research Center, New Orleans, La., in the *Textile Chemist and Colorist*, April, 1978, describe a comparative study of various fungicides in order to determine the feasibility of replacing mercury fungicides in outdoor cottons. The test fungicides were applied by wet padding to plain pearl grey dyed duck, to give conventional and higher than conventional add-ons. The samples treated with fungicide were wax finished in one set, and in another set they were first wax finished and then further finished with standard acrylic coating. The uncoated samples were finished with 3.8% paraffin and the coated samples were treated with 1.3% paraffin and the standard acrylic coating.

Various types of fungicides were tested, including mercury type, copper type, organic sulfuric type, chlorinated phenolic type, quaternary naphthenate type, and pentachlorophenyl laurate type, and the test fungicides included the copper carbonate-zirconyl ammonium carbonate complex, which is chemically similar to the compositions exemplified in U.S. Pat. No. 3,291,635, substituting copper carbonate for copper borate. The test results are to be reported at the end of the spring of 1979.

Conner et al indicate that the copper zirconia fungicides, based on solubilizing copper carbonate in zirconyl ammonium carbonate with a small amount of free ammonium hydroxide, are stable single bath aqueous systems, which deposit insoluble copper-zirconia in the fabric. While the fungicide is a very pale blue, the color is negligible on pearl grey cottons.

After pointing out that copper-zirconia fungicides have consistently given three years protection on canvas duck in tests performed by the Southern Regional Research Center of the U.S. Department of Agriculture, Conner et al conclude that the best protection afforded by all the uncoated fungicidal treatments in the series was given by the copper-zirconia fungicides tested. Cotton fabrics so treated retained 52 to 56% strength, with 1+ mildew ratings, much better than that afforded by the mercury fungicides. The best coated copper-zirconia treated fabric had 70% retained strength, with 0+ mildew ratings, notably superior to the coated mercury treated fabrics.

While the merit of the copper-zirconia fungicides described by Conner and Conner et al is not questioned, Conner and coworkers applied the fungicide from aqueous solutions ranging upwards from a minimum of 0.28 to 0.5% Cu and 0.95 to 1.40% $ZrO_2$. However, such solutions have shown an instability which makes their commercial use impracticable, in the form of a tendency to gel or set-up irreversibly, either before or after application to the textile, and particularly on aging for some time, and before the copper-zirconia complex can be fixed on the fabric by reaction with the cellulose, and it has not been possible to resolve this difficulty.

Aqueous solutions of zirconium salts and particularly ammonium zirconyl carbonate solutions are known to gel at elevated temperatures and on storage for long periods of time, especially when very dilute. According to British Pat. No. 1,337,983 published Nov. 21, 1973, and U.S. Pat. No. 3,741,782 patented June 26, 1973 to Stewart and McAlpine, at temperatures above 40° C. alkali metal zirconyl carbonate solutions and ammonium zirconyl carbonate solutions commence to deposit hydrated zirconium oxide, which appears as a gel, and which can cause the previously mobile solution to solidify completely. Such instability inhibits the use of these solutions in, for example, paper coating systems operating at temperatures greater than 40° C., and in wash coating systems which operate above 40° C. Stewart and McAlpine found that the problem could be avoided by the addition of a diol compound of the general formula:

$$R_1—CHOH—CHOH—R_2$$

where (1) $R_1$ and $R_2$ are the same and represent a COOH group or a salt thereof; or (2) $R_1$ represents a COOH group or a salt thereof and $R_2$ represents a group containing at least two carbon atoms and two OH groups; or (3) $R_1$ and $R_2$ each represent a group containing two carbon atoms and at least one OH group.

These compounds include the hydroxy carboxylic acids or salts thereof, such as tartaric, saccharic, mucic and gluconic acids, as well as sugars, such as mannitol, fructose, and glucose. From 5 to 15% by weight of the diol is preferred, in order to keep the solution stable for at least twenty-four hours at temperatures up to 80° C.

The patentees suggest that the stabilizing agent links with the polymerizable group of the complex, and effectively prevents polymerization of the zirconium complex ion present, thereby rendering the solution stable. However, the polymerizable group is not identified.

In accordance with the invention of Ser. No. 5,412, filed Jan. 22, 1979, now U.S. Pat. No. 4,200,672, patented Apr. 29, 1980, it has now been determined that dilute aqueous copper zirconium ammonium carbonate solutions containing less than about 0.5% Cu and 1.5% $ZrO_2$ and having an enhanced resistance to gelation and the formation of precipitates are obtained, if in the dilute aqueous solution there is present a vicinal diol compound having the general formula:

$$R_1—CHOH—CHOH—R_2$$

wherein $R_1$ and $R_2$ are selected from the group consisting of (1) carboxylic acid groups COOH and salts thereof COOM, where M is a cation, preferably an alkali metal or ammonium, and (2) organic groups having at least two up to about twelve carbon atoms, and at least one OH group;

provided, that when only one of $R_1$ and $R_2$ is a carboxylic acid group or salt thereof, the other of $R_1$ and $R_2$ is an organic group having at least two carbon atoms and two OH groups.

In accordance with the present invention, a process is provided for preparing dilute aqueous copper zirconium ammonium carbonate solutions containing less than about 0.5% Cu and 1.5% $ZrO_2$, having a Cu:Zr atomic ratio within the range from about 0.5:1 to 1:1 and having an enhanced resistance to gelation and the formation of precipitates upon storage of atmospheric temperatures, which comprises mixing aqueous solutions of ammonium copper carbonate and ammonium zirconyl carbonate in proportions selected to form copper zirconium ammonium carbonate in solution in water in a concentration within the range from about 0.1% to about 0.5% Cu, and an amount sufficient to inhibit gelation and precipitation of a vicinal diol compound having the general formula:

$$R_1—CHOH—CHOH—R_2$$

wherein $R_1$ and $R_2$ are selected from the group consisting of (1) carboxylic acids groups COOH and salts thereof COOM, where M is a cation, and (2) organic groups having at least two up to about twelve carbon atoms and at least one OH group; provided, that when only one of $R_1$ and $R_2$ is a carboxylic acid group or salt thereof, the other of $R_1$ and $R_2$ is an organic group having at least two carbon atoms and two OH groups.

This class of compounds includes the vicinal dihydroxy monocarboxylic acids such as glyceric acid, erythronic acid, threonic acid, gluconic acid, galactonic acid, mannonic acid, gluconic acid, idonic acid, attronic acid and allonic acid; and vicinal dihydroxy dicarboxylic acids such as tetrahydroxy adipic acid, mannosaccharic acid, idesaccharic acid, talomucic acid, tartaric acid, trihydroxy glutaric acid, glucouronic acid, galactouronic acid, saccharic acid, and mucic acid.

When $R_1$ and $R_2$ are each organic groups having at least two carbon atoms and at least one OH group, the compounds include polyols such as erythritol and pentaerythritol, as well as sugars and hexahydroxy polyols derived from or analogous to sugars, including mannitol, dulcitol, sorbitol, fructose, dextrose, glucose, galactose, mannose and lactose.

A small amount of the vicinal diol compound is sufficient based on the coordination number of copper and zirconium, six and eight, respectively. An improvement in the resistance to gelation is obtained with amounts as little as 0.1% Cu and 0.28% $ZrO_2$ by weight of the solution.

The vicinal diol compound is believed to form a water-soluble complex with the copper zirconium ammonium carbonate complex salt by coordination or chelation, suggesting the diol compound should be in a stoichiometric amount. Good results are obtained at stoichiometric amounts within the range from about 1% to about 20%, and optimum results at amounts within the range from about 5% to about 15%, by weight of the solution.

The diol compounds are effective stabilizers with aqueous solutions of any insoluble copper salt, including the carbonate and borate, and ammonium zirconium carbonate. These are known complex solutions, and their preparation is described in the Conner U.S. Pat. No. 3,291,635 and in the Conner et al article in *Textile Chemist and Colorist,* referred to above. They can be prepared by methods other than those described in these publications, however. In accordance with the present invention, the following additional procedures are applicable:

(1) Mixing aqueous solutions of ammonium copper carbonate and ammonium zirconyl carbonate.
(2) Dissolving zirconium basic carbonate paste in an aqueous solution of ammonium copper carbonate, ammonium bicarbonate and aqueous ammonium hydroxide.
(3) Dissolving zirconium basic carbonate paste and copper carbonate in an aqueous solution of ammonium hydroxide and ammonium bicarbonate.

Copper carbonate, ammonium copper carbonate, ammonium zirconyl carbonate and zirconium basic carbonate are all commercially available compounds.

The copper zirconium ammonium carbonate complex should have a Cu:Zr atomic ratio within the range from about 0.5 to 1:1. The diol compound chelates with the copper zirconium complex to form a coordination compound or chelate in a stoichiometric ratio corresponding to the coordination numbers of copper and zirconium, which are six and eight, respectively. The coordination compound that is formed appears to contain both copper and zirconium in the molecule, unlike the zirconium complexes of British patent No. 1,337,983 and U.S. Pat. No. 3,741,782 to Stewart and McAlpine, and the structure of the coordination complex is accordingly unknown. It is however believed to involve coordination of the vicinal hydroxyl groups of the stabilizer with the copper and/or zirconium atoms of the copper zirconium ammonium carbonate complex.

It is surprising that the copper zirconium complex forms a stable water-soluble complex with these diol compounds in view of the considerable difference in structure between the copper zirconium complex (such as that postulated by Conner) and the zirconium complexes of the Stewart and McAlpine patents. In the structure postulated by Conner for the copper zirconium complex, the zirconium atom does not have a free hydroxyl group attached, but instead has all of its valences taken up with bulky groups, so that it is quite sterically hindered, and so is the copper atom. Consequently, it is surprising that a coordination complex can form, in this instance.

Even more remarkable is the fact that the coordination complex including the diol compound does undergo heat decomposition, as does the conventional copper zirconium ammonium carbonate complex, and it can be fixed to the cotton fabric. Apparently, the insolubilization reaction does proceed, and the resulting copper zirconium complex fixed on the fabric (which may or may not be the same as that obtained from a solution that does not contain a diol compound) is at least as adherent to and durable and as effective on the cotton fiber as the one produced from the copper zirconium ammonium carbonate not containing the diol compound.

The stable aqueous solutions of copper zirconium ammonium carbonate complex salts in accordance with the invention are obtained simply by mixing and preferably dissolving the stabilizing agent with an aqueous solution of the copper zirconium ammonium complex salt. The chelation reaction takes place at normal atmospheric temperatures.

If the diol compound does not interfere with the reaction between the various reagents used to form the copper zirconium ammonium carbonate complex, it can be added before or during the reaction to form the reaction product, as well as afterwards. For example, if Method (2) above is to be used, the diol compound can be added before, during or after the dissolution of the solid basic zirconium carbonate in the ammonium copper carbonate solution. In Method (3), the diol compound can be added before, during or after the dissolution of copper carbonate and zirconium basic carbonate. In Method (1) the diol compound can be added to the ammonium zirconyl carbonate and/or the ammonium copper carbonate solution before their mixing, or to the final mixture of the two solutions.

The amount of diol compound that is added is sufficient to stabilize the copper zirconium ammonium carbonate complex solutions at a concentration within the range from 0.1 to 0.5% copper against gelation or precipitation after ageing for several weeks at room temperature. This ensures the necessary stability on dilution of a concentrated copper zirconium carbonate solution to from 0.1 to 0.5% copper, prior to use in the treatment of cotton fiber fabrics.

The stabilized copper zirconium ammonium carbonate solutions can be applied to the cotton fabric in any conventional way, for example, by dipping the fabric in the dilute copper zirconium ammonium carbonate solution, padding, and then drying at an elevated temperature, or by spraying the solution on the fabric, or by running the fabric through a bath of the solution. The decomposition of the zirconium copper ammonium carbonate complex and the reaction with the cellulose molecule of the cotton fibers, to fix the copper zirconium compound on the cotton fibers, takes place on heating the treated fabric at an elevated temperature in excess of about 100° C., and preferably about 145° C. Such heating can be combined with the drying step.

Cotton fabric samples treated with the stabilized copper zirconium ammonium carbonate complex solutions in accordance with the invention have a high degree of resistance to attack and degradation by microorganisms, such as fungi, when tested by burial in soil and the usual outdoor exposure methods described in the paper by Conner et al in *Textile Chemist and Colorist*, reported above.

The thermal decomposition of the copper zirconium ammonium carbonate solution yields a highly water-insoluble hydrated zirconia-copper complex that is fixed to the cellulose molecule of the cotton fibers. Leach-testing indicates the very high durability of the zirconia-copper complex which is well fixed to the thermally cured fabric. The high durability of zirconia-copper can be attributed to a cross-linking reaction in which the hydrated zirconia cross-links between vicinal cellulose hydroxyl groups of cellulose chains in the cotton fiber, while the copper is bonded to the zirconia through oxo-bridging. The following mechanism is proposed:

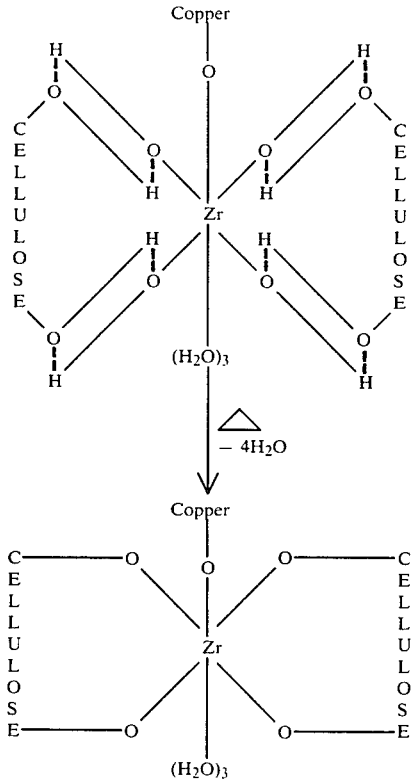

Highly insoluble and durable
Cu-hydrated zirconia complex

The above-proposed reaction mechanism has not been established by experimentation or physical analysis, and therefore is merely one possible explanation of the results that have been noted. It is apparent however, that the copper and zirconia become part of the cellulose molecule, and as a result thereof enhance the resistance of the fabrics to rot. The durability of the biocidal protection appears to be coextensive with the durability of the cross-linked copper-hydrated zirconia complex.

The heat-decomposition product, the insoluble copper-zirconia complex, also appears to enhance the resistance to actinic degradation of the cotton fibers. This is shown experimentally by outer or weathering tests of treated fabrics extending over several months. Cotton duck treated with the stabilized copper zirconium ammonium carbonate solutions and dried at 145° C. has also retained 100% strength after two weeks in a rot bed, and has remained free of mildew and algae growth for several months upon outdoor exposure.

It accordingly follows that the compositions of the invention can be applied not only to cotton fibers but to any fiber having a cellulose chain base, with anhydroglucose units. Exemplary are regenerated cellulose (viscose rayon), cellulose esters such as cellulose acetate and cellulose acetate propionate (acetate rayon), as well as cellulose ethers such as hydroxyethyl cellulose, ethyl cellulose, and methyl cellulose, to enhance the resistance thereof to rot and degradation due to intensive light. The heat treatment should of course be at a temperature below that at which such fibers are deleteriously affected.

In addition, the zirconia-copper complexes fixed on the cotton fabric by thermal curing are less soluble than the corresponding mercury compounds, consequently less toxic, and more durable, with good resistance to actinic degradation. The stabilized copper zirconium ammonium carbonate solutions in accordance with the invention are lower in cost than other copper fungicides, such as copper 8-quinolinate; they have no odor; they are also considerably less soluble than the corresponding mercury compounds.

The following Examples in the opinion of the inventors represent preferred embodiments of the invention:

EXAMPLE 1

250 g of aqueous ammonium zirconyl carbonate solution containing 20.0% $ZrO_2$ was added to 158.8 g of aqueous copper ammonium carbonate solution containing 8.0% Cu. To the obtained mixture 5 g of 100% ammonium tartrate was added and dissolved by mixing at room temperature. The produced concentrated solution contained a Cu: Zr molar ratio of 0.5:1.0. This solution was diluted to a 0.1% copper concentration and stored at room temperature for five weeks. At the end of this time, no instability was noted. No precipitates had been formed and the solution remained clear and fluid.

EXAMPLE 2

250 g of aqueous ammonium zirconyl carbonate solution containing 20.0% $ZrO_2$ was added to 317.6 g of aqueous copper ammonium carbonate solution containing 8.0% Cu. To the obtained mixture 10 g of 100% ammonium tartrate was added and dissolved by mixing at room temperature. The produced concentrated solution contained a Cu:Zr molar ratio of 1.0:1.0. This solution was diluted to a 0.1% copper concentration and stored at room temperature for five weeks. At the end of this time, no instability was noted. No precipitates had been formed and the solution remained clear and fluid.

EXAMPLE 3

5 g of 100% ammonium tartrate was added to 250 g of aqueous ammonium zirconyl carbonate solution containing 20.0% $ZrO_2$. Mixing was applied at room temperature to dissolve the ammonium tartrate. The produced solution was added to 158.8 g of aqueous ammonium copper carbonate solution containing 8.0% Cu. The obtained solution product contained a Cu:Zr molar ratio of 0.5:1.0. This solution was diluted to a 0.1% copper concentration and stored at room temperature for five weeks. At the end of this time no instability was noted. No precipitates had been formed and the solution remained clear and fluid.

EXAMPLE 4

10 g of 100% ammonium tartrate was added to 250 g of aqueous ammonium zirconyl carbonate containing 20.0% $ZrO_2$. Mixing was applied at room temperature to dissolve the ammonium tartrate. The produced solution was added to 317.6 g of aqueous copper ammonium carbonate solution containing 8.0% Cu. The obtained solution product contained Cu:Zr molar ratio of 1.0:1.0. This soluton was diluted to a 0.1% copper concentration and stored at room temperature for five weeks. At the end of this time no instability was noted. No precipitates had been formed and the solution remained clear and fluid.

EXAMPLE 5

5 g of 100% ammonium tartrate was added to 158.8 g of aqueous copper ammonium carbonate solution containing 8.0% Cu. Mixing was applied at room temperature to dissolve the ammonium carbonate. To the produced solution 250 g of aqueous ammonium zirconyl carbonate solution containing 20.0% $ZrO_2$, was added and mixing was applied to obtain homogeneous solution. The obtained concentrate was diluted to 0.1% copper concentration and stored at room temperature for five weeks. At the end of this time, no instability was noted. No precipitates had been formed and the solution remained clear and fluid.

EXAMPLE 6

10 g of 100% ammonium tartrate was added to 317.6 g of aqueous copper ammonium carbonate solution containing 8.0% Cu. Mixing was applied at room temperature to dissolve the ammonium carbonate. To the produced solution 250 g of aqueous ammonium zirconyl carbonate, containing 20.0% $ZrO_2$, was added and mixing was applied to obtain homogeneous solution. The obtained concentrate was diluted to 0.1% copper concentration and stored at room temperature for five weeks. At the end of this time, no instability was noted. No precipitates had been formed and the solution remained clear and fluid.

EXAMPLE 7

18 g of ammonium hydroxide solution containing 29.0% $NH_3$ was added, while mixing, to 100 g of aqueous copper ammonium carbonate containing 8.0% Cu. 80 g of zirconium basic carbonate paste, containing 39.1% $ZrO_2$, was added and mixing was continued until complete dissolving of the paste. 3 g of 100% ammonium tartrate was then dissolved. The produced solution contained a Cu:Zr molar ratio of 0.5:1.0. This solution was diluted to 0.1% copper concentration and stored for five weeks. At the end of this time no instability was noted. No precipitates had been formed and the solution remained clear and fluid.

EXAMPLE 8

18 g of ammonium hydroxide solution containing 29.0% $NH_3$ was added, while mixing, to 200 g of aqueous copper carbonate solution containing 8.0% Cu. 80 g of zirconium basic carbonate paste, containing 39.1% $ZrO_2$, was added and mixing was continued until complete dissolving of the paste. 6 g of 100% ammonium tartrate was then dissolved. The produced solution contained a Cu:Zr molar ratio of 1.0:1.0. This solution was diluted to 0.1% copper concentration and stored for five weeks. At the end of this time no instability was noted. No precipitates had been formed and the solution remained clear and fluid.

EXAMPLE 9

3 g of 100% ammonium tartrate was dissolved in 100 g of aqueous copper ammonium carbonate solution containing 8.0% Cu and 18.0 g of ammonium hydroxide solution, containing 29.0% $NH_3$, was then added, while mixing. 80 g of zirconium basic carbonate paste, containing 39.1% $ZrO_2$, was added and mixing was continued until complete dissolving of the paste. The produced solution had a Cu:Zr molar ratio of 0.5:1.0. This solution was diluted to 0.1% copper concentration and stored at room temperature for five weeks. At the end of this period no instability was noted. No precipitates had been formed and the solution remained clear and fluid.

EXAMPLE 10

6 g of 100% ammonium tartrate was dissolved in 200 g of aqueous copper ammonium carbonate solution, containing 8.0% Cu, and 18 g of ammonium hydroxide solution, containing 29.0% $NH_3$ was then added, while mixing. 80 g of zirconium basic carbonate paste containing 39.1% $ZrO_2$ was added and mixing was continued until complete dissolving of the paste. The produced solution had a Cu:Zr molar ratio of 0.5:1.0. This solution was diluted to 0.1% copper concentration and stored at room temperature for five weeks. At the end of this period no instability was noted. No precipitates had been formed and the solution remained clear and fluid.

EXAMPLE 11

1.6 g of mannitol was added to 77.5 g of aqueous ammonium zirconyl carbonate containing 20.0% $ZrO_2$. To the produced solution 11 g of ammonium hydroxide solution, containing 29.0% $NH_3$, was added while mixing. 10 g of 100% copper carbonate powder was then added and mixing was continued until complete dissolving of the powder. The produced solution contained a Cu:Zr molar ratio of 0.67:1.00. This solution was diluted to 0.1% copper concentration and stored at room temperature for five weeks. At the end of this period no instability was noted. No precipitates had been formed and the solution remained clear and fluid.

EXAMPLE 12

1.6 g of 100% ammonium tartrate was added to 77.5 g of aqueous ammonium zirconyl carbonate containing 20.0% $ZrO_2$. To the produced solution 11.0 g of ammonium hydroxide solution, containing 29.0% $NH_3$, was added, while mixing. 10.0 g of 100% copper carbonate powder was then added and mixing was continued until complete dissolving of the powder. The produced solution contained a Cu:Zr molar ratio of 0.67:1.00. This solution was diluted to 0.1% copper concentration and stored at room temperature for five weeks. At the end of this period no instability was noted. No precipitates had been formed and the solution remained clear and fluid.

This composition was applied to a cotton duck by dipping the fabric in the diluted solution, padding, and then drying at 145° C. for one-half hour.

One set of the resulting fabric samples was wax finished and another set wax finished and further finished with a standard acrylic coating, using the procedure described by Conner et al in *Textile Chemist and Colorist*, referred to above. The uncoated samples were finished with 3.8% paraffin and the coated samples were treated with 1.3% paraffin and the standard acrylic coating.

Coated and uncoated samples were exposed in Tombstone, Ariz., Knoxville, Tenn., and New Orleans, La. The evaluations at Tombstone were for actinic (sunlight) degradation. The evaluations at New Orleans were for actinic degradation and mildew or humidity degradation, and at Knoxville intermediate actinic and mildew degradation, less severe than in the New Orleans area.

The evaluations covered a period of thirty-six months. Warp breaking strength and visual mildew ratings were measured and averaged from the three locations at six month intervals. The mildew rating reflects damage to the aesthetic appearance of the fabric, whereas the harmful effect on fabric strength is demonstrated from warp break values.

Performance evaluations were based on percent retained warp breaking strength, and visual mildew ratings from 0 to 5. For each location, breaking strength evaluation was based upon an average of five breaks.

Similarly, mildew ratings were based upon an average of ratings by two panel members. Although every sample in each of three locations was evaluated to rate performance, values reported below are composite averages for all three weathering sites.

The average three-location percent retained strength for each six months of exposure must exceed 20% of the original fabric's warp strength before exposure, to be considered satisfactory. Values of 20% or lower constitute failure.

The average three-location excessive mildew growth ratings for each six months of exposure must not average a rating of 3 or higher (5 being maximum). Mildew ratings averaging 3 or higher constitute failure.

The results obtained in comparison with the same composition containing no diol compound were identical in every respect, showing the diol compound does not interfere with the fungicidal activity.

Having regard to the foregoing disclosure, the following is claimed as the inventive and patentable embodiments thereof:

1. A process for preparing dilute aqueous copper zirconium ammonium carbonate solutions containing less than about 0.5% Cu and 1.5% $ZrO_2$, having a Cu:Zr atomic ratio within the range from about 0.5:1 to 1:1 and having an enhanced resistance to gelation and the formation of precipitates, upon storage at atmospheric temperatures, which comprises mixing aqueous solutions of ammonium copper carbonate and ammonium zirconyl carbonate in proportions selected to form copper zirconium ammonium carbonate in solution in water in a concentration within the range from about 0.1% to about 0.5% Cu, and an amount sufficient to inhibit gelation and precipitation of a vicinal diol compound having the general formula:

$$R_1—CHOH—CHOH—R_2$$

wherein $R_1$ and $R_2$ are selected from the group consisting of (1) carboxylic acids groups COOH and salts thereof COOM, where M is a cation, and (2) organic groups having at least two up to about twelve carbon atoms and at least one OH group; provided, that when only one of $R_1$ and $R_2$ is a carboxylic acid group or salt thereof, the other of $R_1$ and $R_2$ is an organic group having at least two carbon atoms and two OH groups.

2. A process for preparing an aqueous copper zirconium ammonium carbonate solution according to claim 1, which comprises mixing the diol compound with an aqueous solution of the copper zirconium ammonium carbonate salt, and allowing the chelation reaction to take place at normal atmospheric temperature.

3. A process for preparing an aqueous copper zirconium ammonium carbonate solution according to claim 1, in which the diol compound is added before or during the reaction to form the copper zirconium ammonium carbonate reaction product.

4. A process for preparing dilute aqueous copper zirconium ammonium carbonate solutions which comprises dissolving zirconium basic carbonate paste in an aqueous solution of ammonium copper carbonate, ammonium bicarbonate and aqueous ammonium hydroxide in proportions selected to form copper zirconium ammonium carbonate in solution in water in a concentration within the range from about 0.1% to about 0.5% Cu, and an amount sufficient to inhibit gelation and precipitation of a vicinal diol compound having the general formula:

$$R_1—CHOH—CHOH—R_2$$

wherein $R_1$ and $R_2$ are selected from the group consisting of (1) carboxylic acids groups COOH and salts thereof COOM, where M is a cation, and (2) organic groups having at least two up to about twelve carbon atoms and at least one OH group; provided, that when only one of $R_1$ and $R_2$ is a carboxylic acid group or salt thereof, the other of $R_1$ and $R_2$ is an organic group having at least two carbon atoms and two OH groups.

5. A process for preparing an aqueous copper zirconium ammonium carbonate solution according to claim 4, in which the diol compound is added before or during the reaction to form the copper zirconium ammonium carbonate reaction product.

6. A process for preparing aqueous copper zirconium ammonium carbonate solutions which comprises dissolving zirconium basic carbonate paste and copper carbonate in an aqueous solution of ammonium hydroxide and ammonium bicarbonate in proportions selected to form a copper zirconium ammonium carbonate in solution in water in a concentration within the range from about 0.1% to about 0.5% Cu, and an amount sufficient to inhibit gelation and precipitation of a vicinal diol compound having the general formula:

$$R_1—CHOH—CHOH—R_2$$

wherein $R_1$ and $R_2$ are selected from the group consisting of (1) carboxylic acids groups COOH and salts thereof COOM, where M is a cation, and (2) organic groups having at least two up to about twelve carbon atoms and at least one OH group; provided, that when only one of $R_1$ and $R_2$ is a carboxylic acid group or salt thereof, the other of $R_1$ and $R_2$ is an organic group having at least two carbon atoms and two OH groups.

7. A process for preparing an aqueous copper zirconium ammonium carbonate solution according to claim 6, in which the diol compound is added before or during the reaction to form the copper zirconium ammonium carbonate reaction product.

* * * * *